US005336964A

United States Patent [19]

Capek et al.

[11] Patent Number: 5,336,964

[45] Date of Patent: Aug. 9, 1994

[54] CRT TENSION MASK SUPPORT STRUCTURE

[75] Inventors: Raymond G. Capek, Elmhurst; Siegfried M. Greiner, Crystal Lake; Hua S. Tong, Arlington Heights, all of Ill.

[73] Assignee: Zenith Electronics Corporation, Glenview, Ill.

[21] Appl. No.: 934,596

[22] Filed: Aug. 24, 1992

[51] Int. Cl.[5] ..... H01J 29/81

[52] U.S. Cl. ..... 313/407; 313/402; 313/404; 313/408

[58] Field of Search ..... 313/402, 404, 405, 407, 313/408

[56] References Cited

U.S. PATENT DOCUMENTS

| | | | |
|---|---|---|---|
| Re. 33,253 | 7/1990 | Strauss | 313/402 |
| 2,842,696 | 7/1958 | Fischer-Colbrie . | |
| 4,737,681 | 4/1988 | Dietch et al. | 313/402 |
| 4,745,328 | 5/1988 | Strauss | 313/407 |
| 4,779,023 | 10/1988 | Strauss | 313/407 |
| 4,891,545 | 1/1990 | Capek et al. | 313/407 |
| 5,017,170 | 5/1991 | Dougherty et al. | 445/30 |
| 5,023,507 | 6/1991 | Dougherty et al. | 313/407 |

FOREIGN PATENT DOCUMENTS 1477706 3/1967 France .

*Primary Examiner*—Donald J. Yusko
*Assistant Examiner*—Vip Patel
*Attorney, Agent, or Firm*—Roland W. Norris

[57] ABSTRACT

A faceplate assembly for a color CRT includes a glass panel with a phosphor screen thereon and a plated mask support structure attached to the faceplate, with a foil shadow mask welded in tension to the mask support structure. The mask support structure comprises an inert substrate to which is electroformed a weld land suitable for accepting welds and retaining the mask thereby. A minimal amount of metal is used and the shape and size of the mask support are readily controllable.

6 Claims, 2 Drawing Sheets

CRT TENSION MASK SUPPORT STRUCTURE

BACKGROUND

1. Field of the Invention

The present invention relates to cathode ray tubes (CRTs) with front panel assemblies having tensed shadow masks supported on the faceplate of the CRT by mask support structures affixed to the faceplate. More specifically, the present invention relates to a front panel assembly with an efficacious mask support structure and a method of making same.

2. Discussion of the Related Art

As is known in the art, there are color CRTs having front panel assemblies comprising thin foil shadow masks welded under tension to mask support structures affixed to the faceplate of the CRT. These shadow masks by definition act as parallax barriers to direct the electron beamlets to the proper phosphor dot on the CRT screen. Exemplary mask support structures for known types of CRT front panel assemblies are illustrated in FIGS. 1 and 2. These structures are more fully disclosed and claimed in U.S. Pat. Nos. 4,737,681 and 4,891,545 respectively, commonly assigned to the Assignee hereof.

The front panel assembly 9 of FIG. 1 comprises a glass faceplate 19 carrying a phosphor screen 12 and a mask support structure 11 which comprises a ceramic body 13 and a metal alloy cap 15, of approximately thirty two mils thick stock, attached to the body 13 by a devitrifying frit 17. The whole mask support structure is then attached to the CRT faceplate 19 with devitrifying frit 17. The metal alloy cap 15 is then ground to provide a weld land 35 at the correct "Q" height. A tensed, thin, foil shadow mask 18 is then welded directly, i.e. without intervening filler metals, to the weld land 35 of the mask support structure.

As seen in FIG. 2, the mask support structure 23 is comprised of an inverted "V" - shaped metal alloy 25, of approximately twenty-four mil thick stock, which is filled with devitrifying frit 17 and secured by additional devitrifying frit to the faceplate 19. The mask support structure 23 is then ground to provide a weld land 35 at the correct "Q" height. The tensed foil mask 18 is then welded to the weld land 35.

While the embodiments of FIGS. 1 and 2 are structurally adequate for forming a tensed mask color CRT front panel assembly, some economies of manufacturing may be had through utilization of the presently disclosed invention.

It is an object of the present invention to provide a front panel assembly for a tensed mask color CRT which is inexpensive and utilizes little metal, while providing a mask support structure capable of accepting welds strong enough to hold the foil mask in tension thereon. It is also preferable that this mask support structure be controllable to close tolerance in the overall height thereof.

A BRIEF DESCRIPTION OF THE DRAWINGS

Other attendant advantages will be more readily appreciated as the invention becomes better understood by reference to the following detailed description and compared in connection with the accompanying drawings in which like reference numerals designate like parts throughout the figures. It will be appreciated that the drawings may be exaggerated for explanatory purposes.

DESCRIPTION OF THE PREFERRED EMBODIMENT

Figure 1:
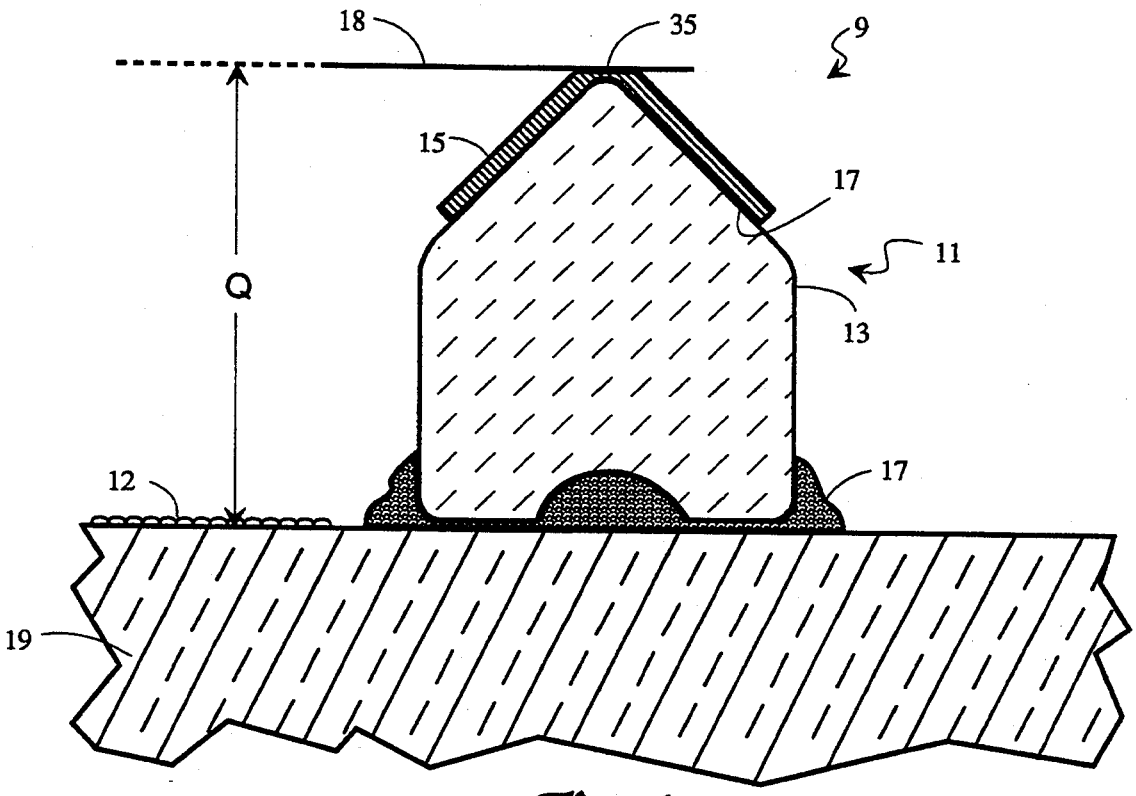
Fig. 1 (PRIOR ART)
FIG. 1 illustrates a known front panel assembly having a mask support structure suitable for use with a tensed mask color CRT.
Figure 2:
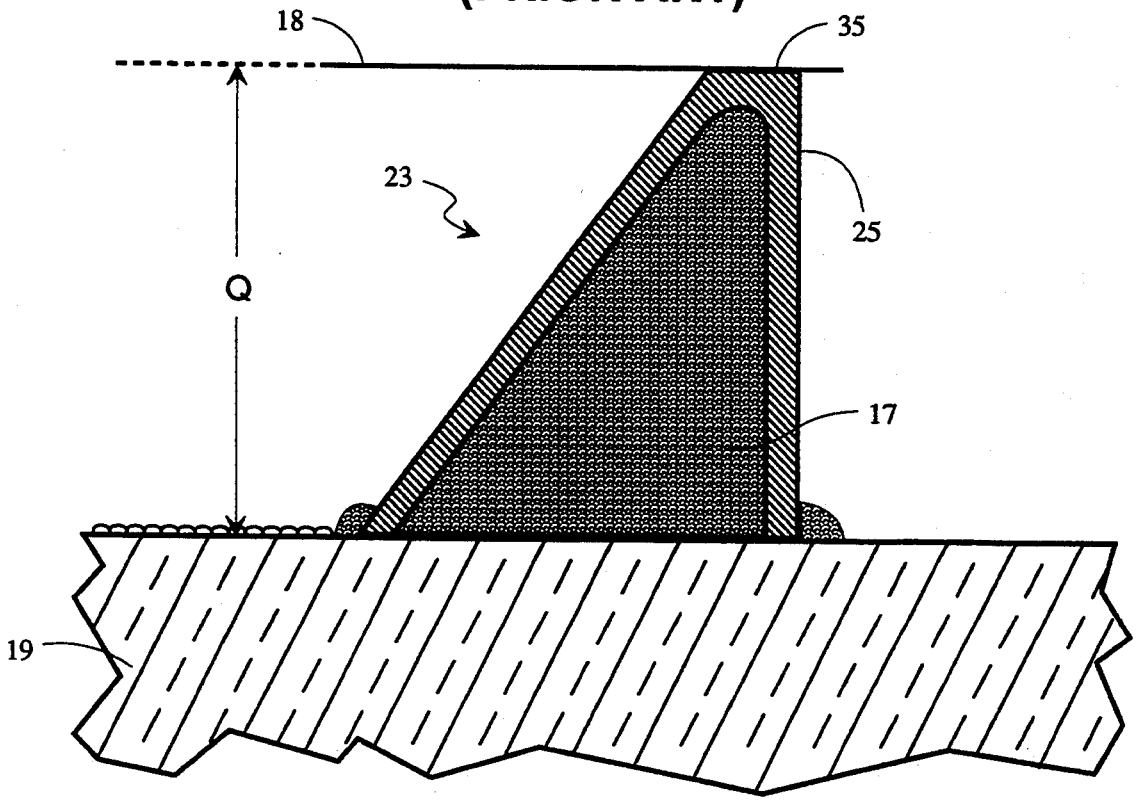
Fig. 2 (PRIOR ART)
FIG. 2 illustrates another known embodiment of a front panel assembly having a mask support structure suitable for use with a tensed mask color CRT.
Figure 3:
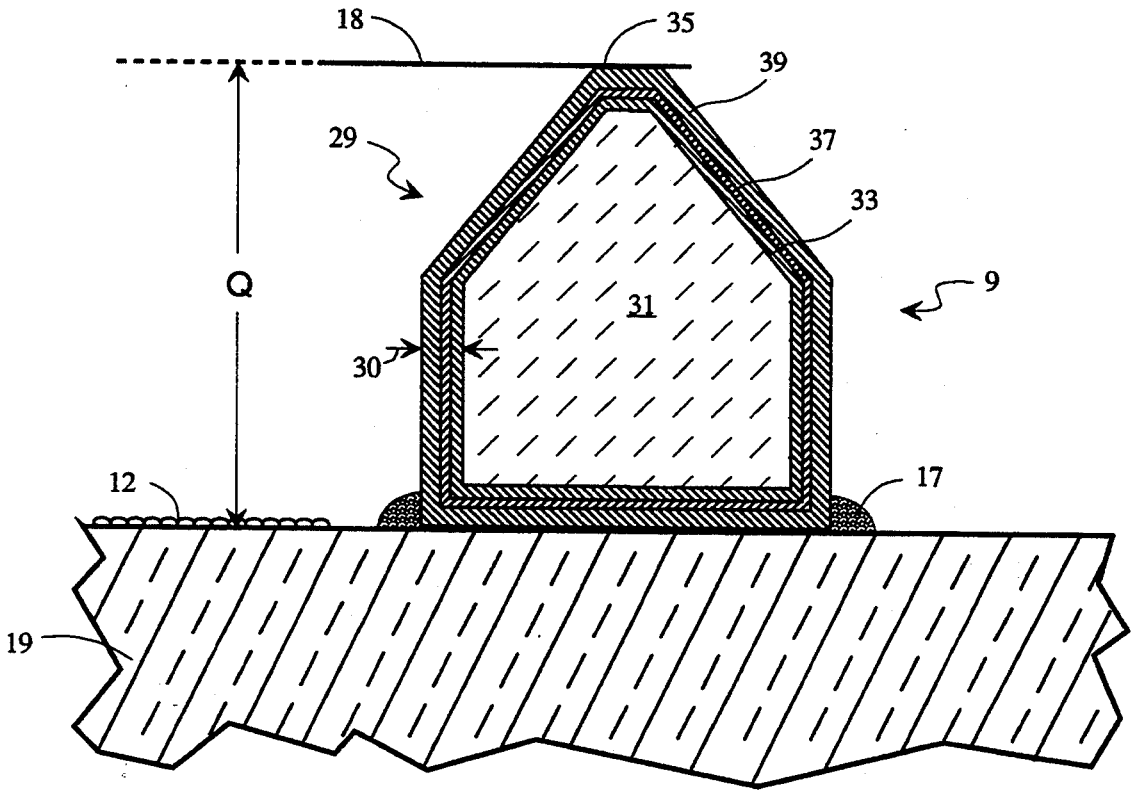
FIG. 3 is a cross section of a front panel assembly according to the present invention.

As seen in FIG. 3, a front panel assembly 9 according to the present invention comprises a glass faceplate 19 carrying on phosphor screen 12 and a mask support structure 29 having an inert substrate 31 of near net shape to the desired mask support structure 29 with metal plating 30 thereon to which is welded a tensed foil shadow mask 18. The metal plating thickness is greatly exaggerated for ease of explanation. "Inert" is defined herein as nonreactive with the CRT environment. A suitable inert substrate composition would be a fosterite ceramic as described in the above mentioned U.S. Pat. No. 4,737,681. Any substrate composition which is subject to adequate dimensional control, has a proper coefficient of thermal expansion, for example $97\text{–}107\times10-7$ in/in/C.°, is temperature resistant to the extent necessary for subsequent CRT processing e.g.. 450° C., and will not decompose and is otherwise suited for the CRT environment can be used.

The metal plating 30 comprises, firstly, a conditioning layer of electrically conductive material 33 adhered to the inner substrate 31 to facilitate the electroforming of the weld land 35 of the mask support structure 29, as further explained below. The conductive material may, for example, be comprised of silver and applied as a silver paste, a silver-containing glass frit, or applied as a pure silver metal spray. The thickness of this conductive layer 33 should be as thin as possible, as it only needs to conduct enough electricity to facilitate the subsequent forming of the weldable metal layer thereon. Five hundred angstroms of an applied silver paste has been found to be suitable.

A thin layer 37 of weldable material such as nickel is then deposited upon the conductive layer 33 by an electroless coating process, e.g.. in the 500–1,000 angstrom range. By using an electroless coating techniques the nickel layer 37 is intimately adhered to the conductive layer 33. After electroless plating, a thicker layer 39 of nickel or other suitable weldable plating is then quickly, easily, and controllably electroformed onto the base thin nickel layer 37, resulting in the substrate 31 being clad with weldable plating to the thickness of about 40–120 microns as necessary or desired. The plating of FIG. 3 produces a weld land 35 sufficient for holding the tensed mask with a minimum of metal and no crevices or gaps to capture contaminants which might later damage the CRT screen area. The mask support structure is well controlled as to "Q" height, but may accept a minimal amount of surface grinding on the weld land as may be required by manufacturing practice. The ceramic substrate 31 may likewise be preground to close tolerance as necessary before the metal plate 30 is applied thereto. Alternatively, that surface of the mask support structure which is to be affixed to the faceplate may be ground after the substrate is clad and then measured, to achieve close tolerances in mask support surface height. The mask support structure 29 may then be fritted to the faceplate 19 and the mask 18 welded thereto by known manufacturing processes.

Should residual stresses be found in the weldable layer suitable stress relief chemicals, such as saccharin, can be added to the electroforming solution to minimize the residual stress. Current density during the electroforming process can be varied, depending on the mechanical properties required and the electroforming efficiency available.

Figure 4:
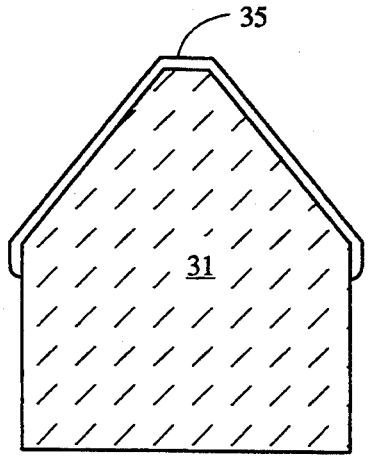
FIG. 4 is an alternative embodiment of a mask support structure for the front panel assembly according to the present invention.

Alternatively, as seen in FIG. 4, the entire inert substrate 31 need not be plated, but only the top half or other significant portion containing the weld land 35, as deemed necessary or desirable. Also, the inert substrate 31 may be affixed to the faceplate before the electroforming thereof takes place. It is recommended in this procedure that the area of the faceplate to which the screen will be subsequently applied be masked from the electroforming solution.

The inert substrate 31 may, alternatively, be comprised of a material conductive at its surface, in which case, the thin conditioning layer of electrically conductive material 33 need not be applied thereto. Such a substrate must, of course, retain compatibility with the tube environment and meet the other criteria as set forth above. For example, a fosterite substrate having a doped ceramic outer layer or the development of high-temperature conductive polymers meeting the above requirements is envisioned.

While the present invention has been illustrated and described in connection with the preferred embodiments, it is not to be limited to the particular structure shown, because many variations thereof will be evident to one skilled in the art and are intended to be encompassed in the present invention as set forth in the following claims:

Having thus described the invention, what is claimed is:

1. A front panel assembly for a color CRT comprising;

a) a glass panel adapted to be affixed to a CRT funnel;

b) a phosphor screen adhered to a surface of the glass panel;

c) a discrete mask support structure affixed to the panel and bounding the screen, the mask support structure comprising:

1) an inert substrate of near net shape to the desired mask support structure;

2) a layer of electrically conductive material adhered to the substrate;

3) a layer of weldable plating adhered to the layer of conductive material, the layer of weldable plating being substantially in the range of forty to one hundred twenty microns thickness to accept a direct weld capable of retaining the shadow mask in tension thereon, d) a tensed foil shadow mask directly welded to the plating of the mask support structure.

2. The front panel assembly of claim 1 wherein: the inert substrate is a ceramic composition.

3. The mask support structure of claim 1 wherein: the electrically conductive material is comprised of silver.

4. The mask support structure of claim 1 wherein: the layer of weldable plating is comprised of nickel.

5. The mask support structure of claim 1 wherein: the substrate is substantially completely covered by the layer of weldable plating.

6. The mask support structure of claim 1 wherein: the substrate is partially covered by the layer of weldable plating.

* * * * *